United States Patent [19]

Focke et al.

[11] Patent Number: 4,614,075

[45] Date of Patent: Sep. 30, 1986

[54] PACKAGING MACHINE WITH A SUPPLY HOLDER FOR REELS

[75] Inventors: Heinz Focke; Kurt Liedtke, both of Verden, Fed. Rep. of Germany

[73] Assignee: Focke & Co., (GmbH & Co.), Verden, Fed. Rep. of Germany

[21] Appl. No.: 671,669

[22] Filed: Nov. 15, 1984

[30] Foreign Application Priority Data

Nov. 23, 1983 [DE] Fed. Rep. of Germany ..... 3342204

[51] Int. Cl.[4] ..... B65B 41/12

[52] U.S. Cl. ..... 53/168; 242/58; 242/64

[58] Field of Search ..... 53/168; 242/58, 64, 242/55.3

[56] References Cited

U.S. PATENT DOCUMENTS

| | | | |
|---|---|---|---|
| 3,295,777 | 1/1967 | Carroll | 242/55.3 |
| 3,381,911 | 5/1968 | Thomas et al. | 242/56 A |
| 3,546,850 | 12/1970 | Hatanaka et al. | 53/168 X |
| 3,586,252 | 6/1971 | Sutton | 242/55.3 |
| 3,702,672 | 11/1972 | Becht | 242/55.3 X |
| 3,815,313 | 6/1974 | Heisler | 53/168 X |
| 4,466,577 | 8/1984 | Focke et al. | 242/64 X |

*Primary Examiner*—James F. Coan

*Attorney, Agent, or Firm*—Sughrue, Mion, Zinn, Macpeak, and Seas

[57] ABSTRACT

High-performance packaging machines, especially for cigarettes, require a large quantity of packaging material for producing blanks. The sheet-like packaging material is provided in reels (24). To provide a sufficient supply of reels (24) for the packaging machine (20), there is a reel magazine (26) which has a reel turret (27) with a plurality of reel holders (32, 33, 34). Each reel holder (32, 33, 34) itself receives a plurality of reels (24) arranged equiaxially next to one another. These are fed in succession to a consumption station (25) or reel-receiving devices (28, 29).

19 Claims, 10 Drawing Figures

PACKAGING MACHINE WITH A SUPPLY HOLDER FOR REELS

DESCRIPTION

Figure 1:
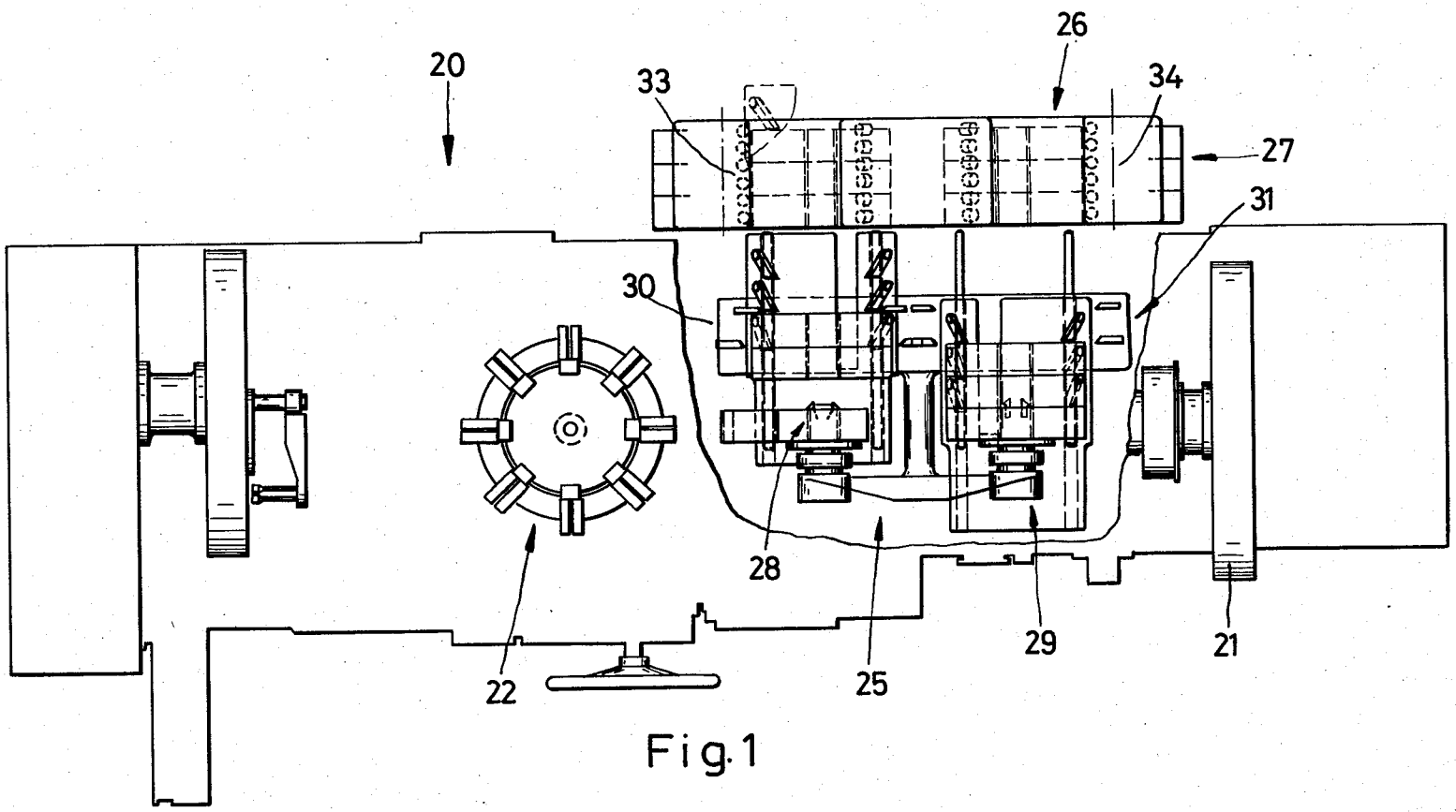

The invention relates to a packaging machine, especially for cigarettes, in which blanks consisting of packaging material (tin foil) are severed from a sheet of material wound into a reel, and in which several reels are provided in a supply holder and can be conveyed in succession into a consumption position.

High-performance packaging machines, especially for producing cigarette packs, have a high consumption of packaging material. In as much as blanks are produced, in the region of the packaging machine, by being severed from a continuous sheet of packaging material, it is necessary to provide a sufficient quantity of this packaging material wound into reels. It is time-consuming and troublesome to change the reels in a region of the consumtion position.

In a known packaging machine (DE-A No. 3,026,995), a number of reels arranged equiaxially next to one another are provided in a trough-shaped supply holder. The particular reel at the front or facing the consumption station is located on a reel holder which is conventionally designed so that the sheet of packaging material can be drawn off from the reel. Within the supply holder the reels rest on conveyor belts which, after a reel has been consumed, bring up the particular reel which comes next.

By means of this known apparatus, a certain number of reels can be held ready and called up as required. However, the capacity of this supply holder is sufficient for a limited working period only. Moreover, the problem of changing the reels in the region of the consumption station has not yet been solved in the best possible way.

The object on which the invention is based is to propose a packaging machine which is provided with a highcapacity supply holder for reels and which allows consumed reels to be exchanged quickly and reliably for a reel from the supply.

To achieve this object, the packaging machine according to the invention is defined by a reel magazine with a plurality of reel holders which are movable in succession into an extraction position.

The reel magazine is preferably designed as a reel turret, the trough-shaped reel holders of which are arranged on a supporting frame which rotates periodically about a preferably horizontal axis of rotation. It is expedient to arrange six reel holders axis-parallel relative to one another and at equal angular distances from one another. Two reel holders arranged next to one another are always located in the extraction position. The supporting frame with the reel holders is moved further periodically when the two reel holders in the extraction position have been emptied.

The trough-shaped reel holders of the reel turret are designed so that a plurality of reels supported equiaxially next to one another are grasped and retained solely on the periphery. Because of the high capacity, the total number of reels of the reel turret can be selected so that the quantity required for a working shift is covered. Consequently, the packaging machine is "loaded" only once before the start of the shift.

According to a further proposal of the invention, the reel holders have assigned to them in the region of the extraction position (two) reel conveyors which are responsible for transferring the reels from the reel holders to a reel-receiving device (consumption station). According to the invention, these reel conveyors are designed so that they each accept the total content of a reel holder and then feed the reels individually to the reel-receiving device according to the level of consumption.

Further features of the invention relate to the design of the reel turret, the reel holders, the reel conveyor and devices in the region of the consumption station.

Figure 2:
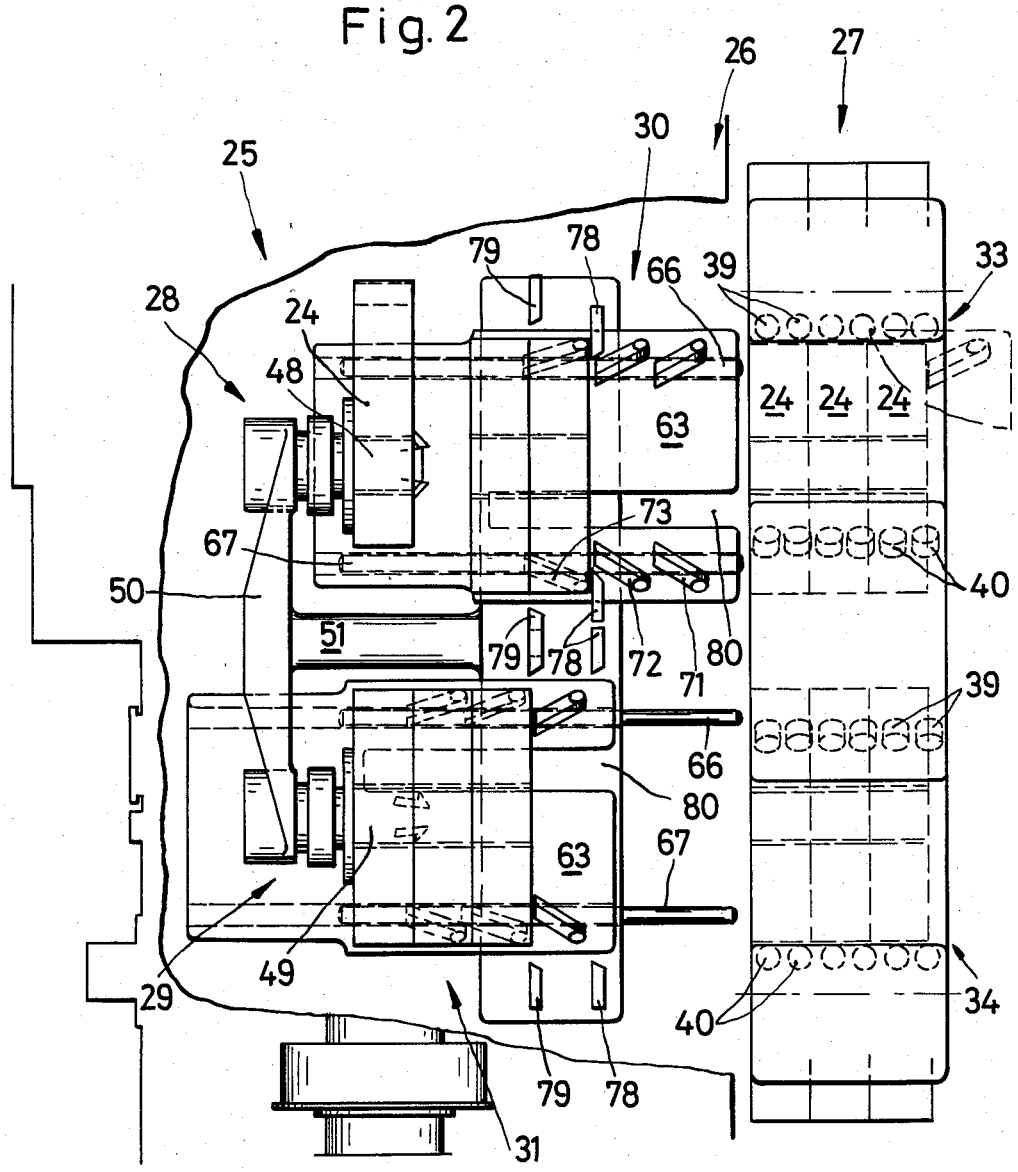
Figure 3:
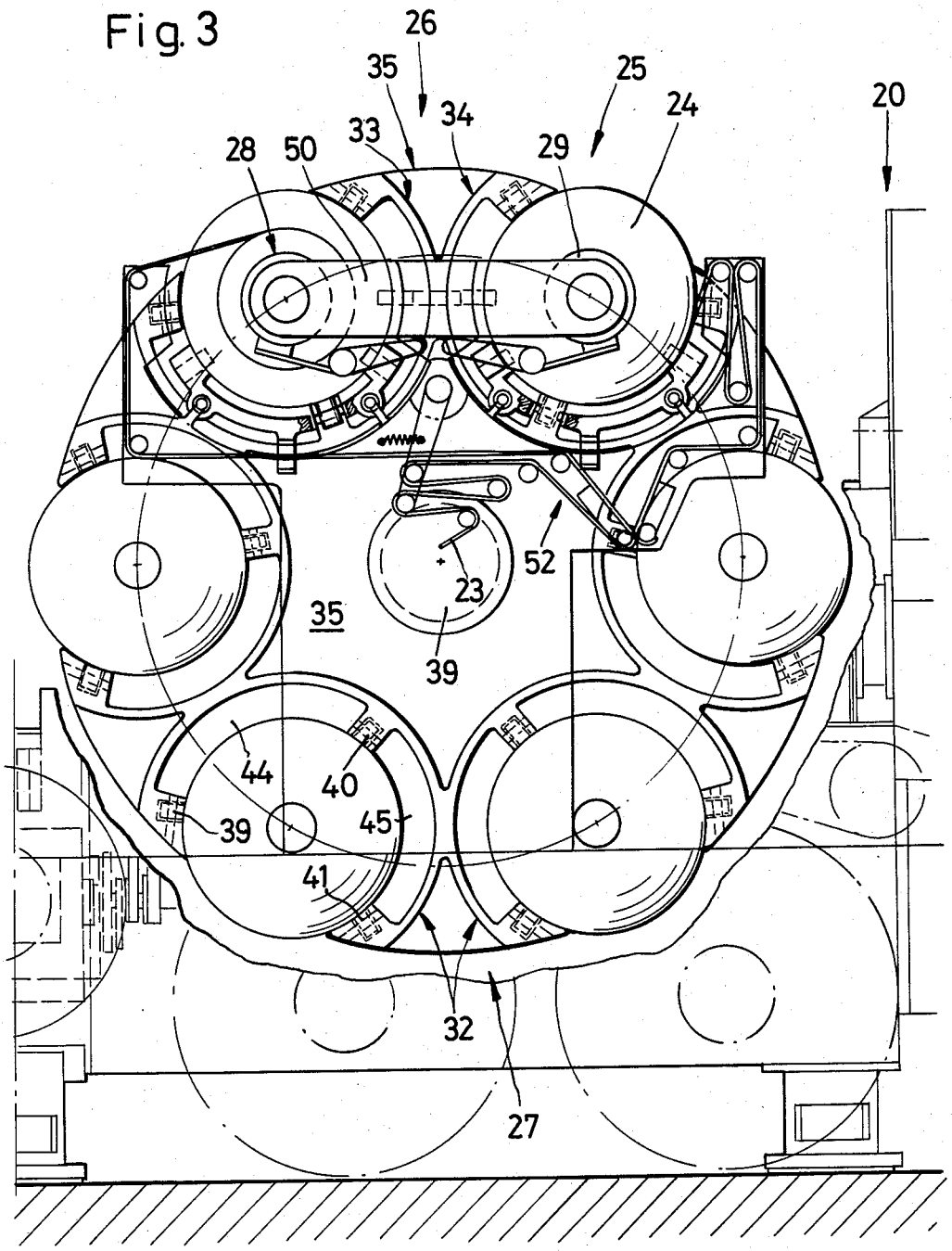
Figure 4:
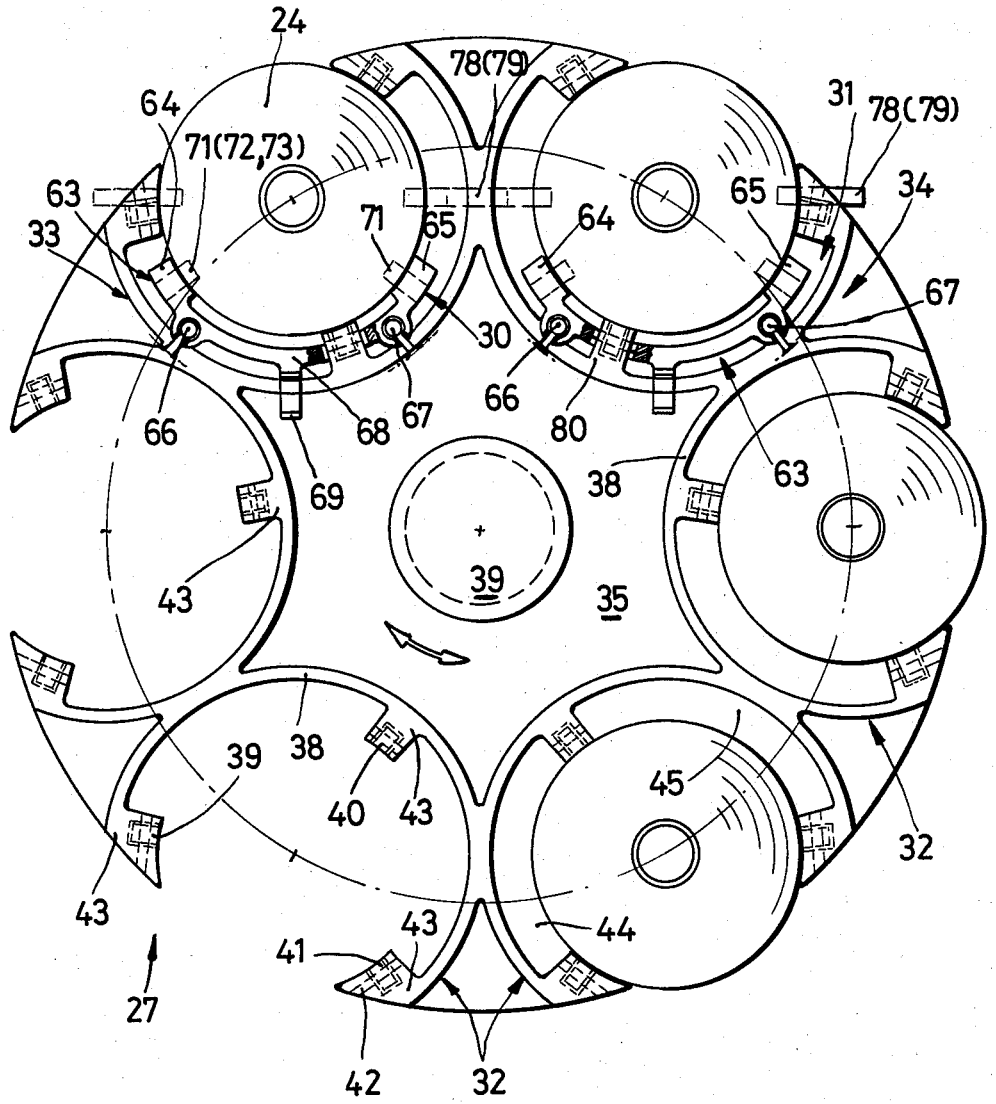
Figure 5:
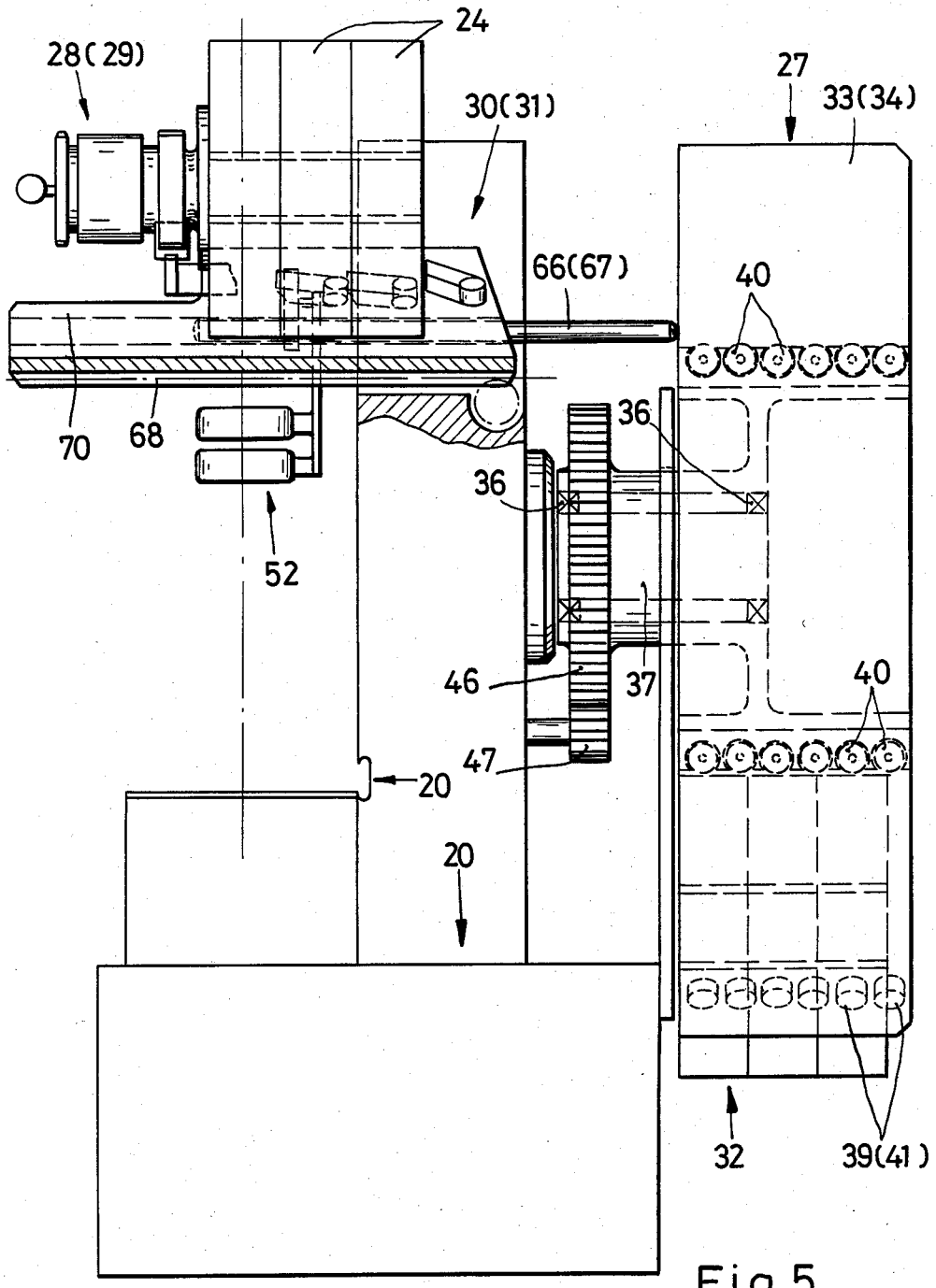
Figure 6:
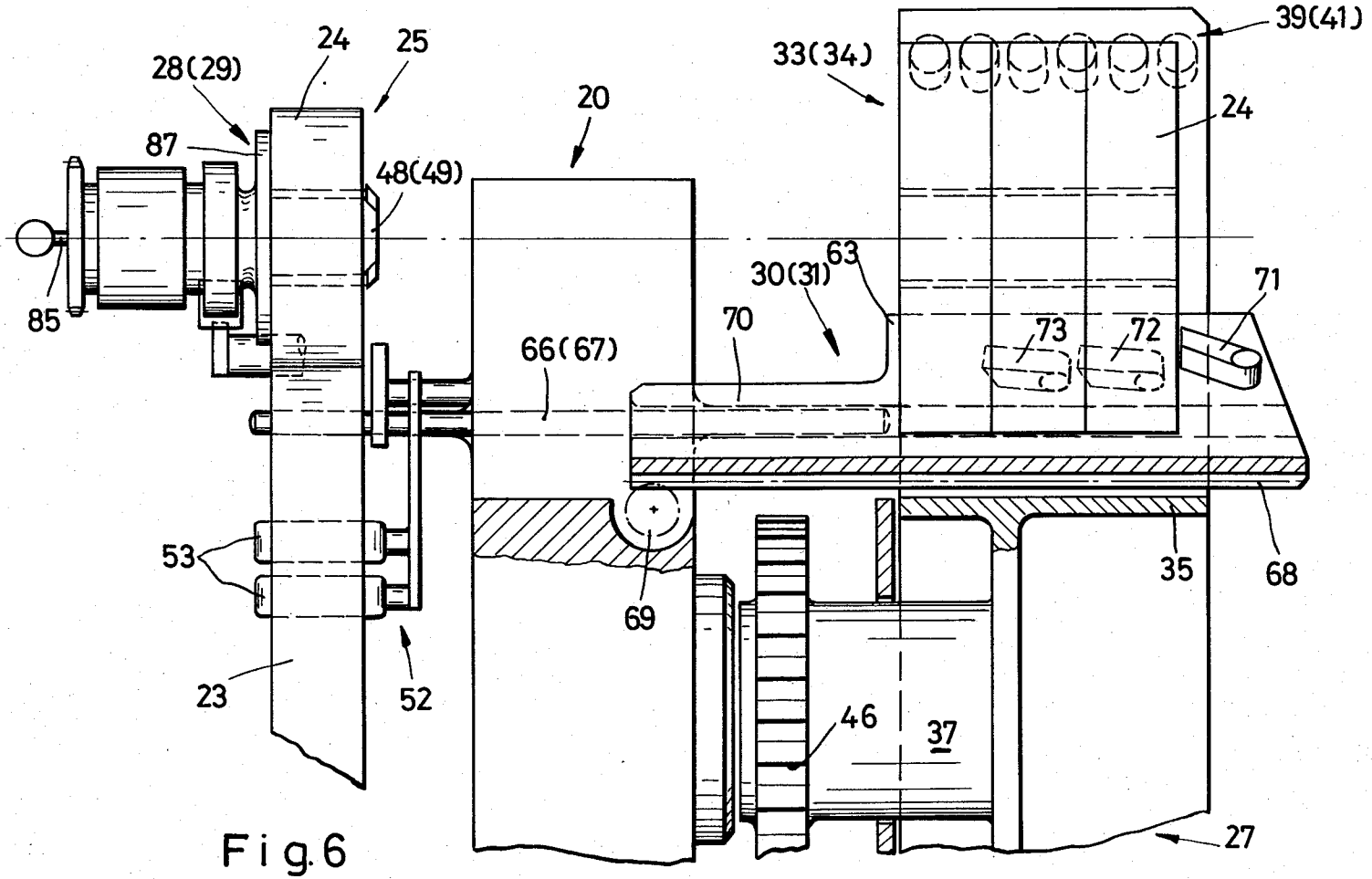
Figure 7:
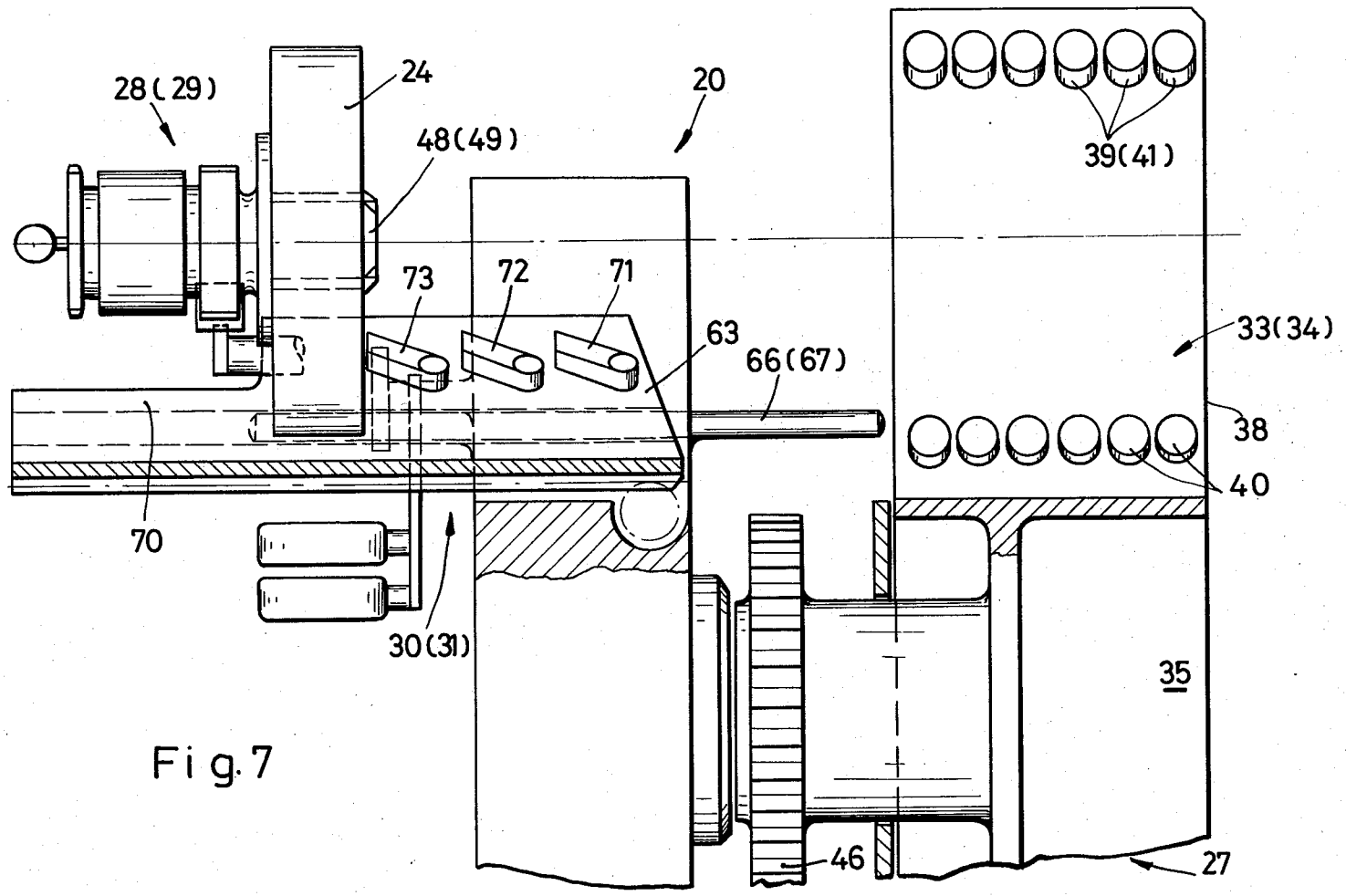
Figure 8:
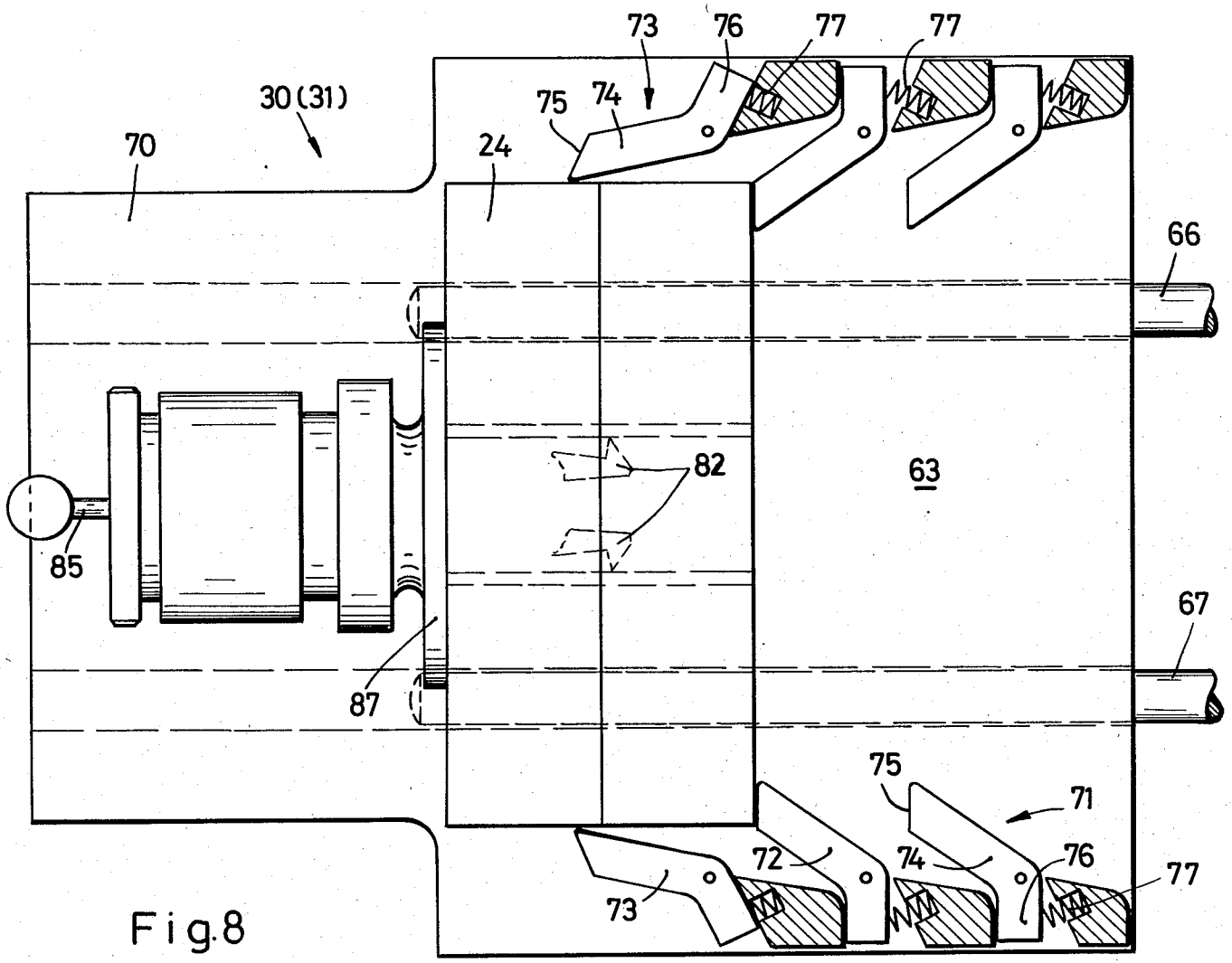
Figure 9:
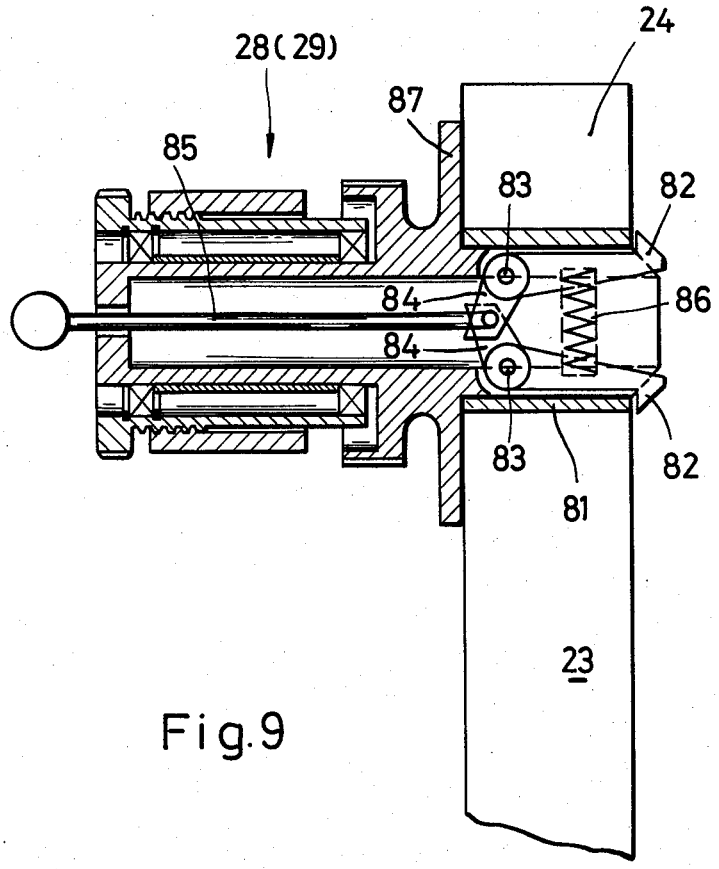
Figure 10:
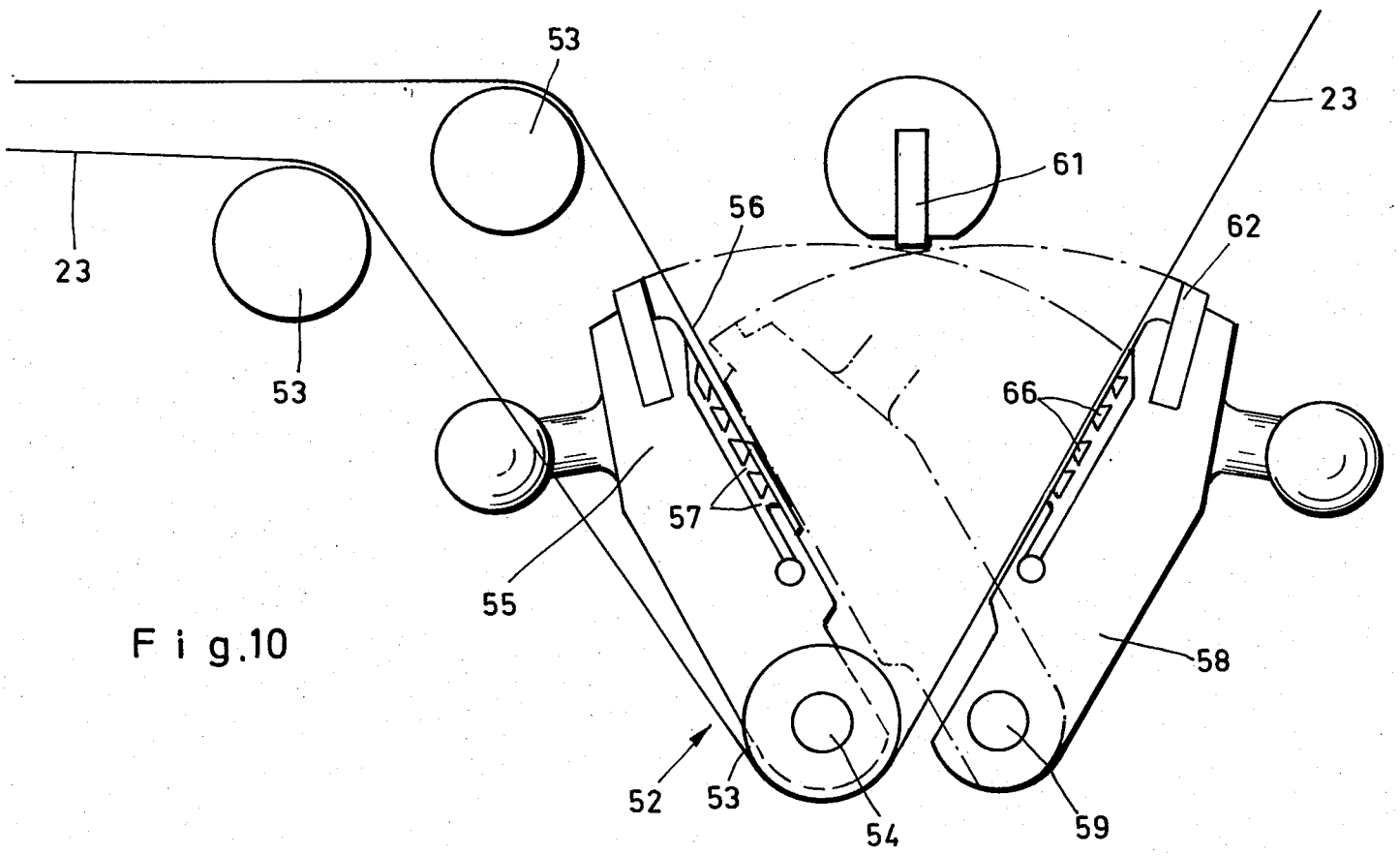

An exemplary embodiment of the invention is explained in more detail below with reference to the drawings in which:

FIG. 1 shows a packaging machine with a reel magazine in a diagramatic horizontal projection, FIG. 2 shows the reel magazine according to FIG. 1 on an enlarged scale as a detail, FIG. 3 shows the reel magazine in a rear view approximately of the scale of FIG. 2, FIG. 4 shows a rear view of details of a reel turret as part of the reel magazine, FIG. 5 shows, in a side view and in cross-section, the reel magazine in conjunction with contours of the packaging machine, FIG. 6 shows a representation, similar to that of FIG. 5, of a cut-out of the reel magazine, with a changed relative position of individual parts, FIG. 7 shows a representation corresponding to FIG. 6, with a further changed relative position of parts of the apparatus, FIG. 8 shows a reel conveyor as part of the reel magazine in a horizontal projection and on an enlarged scale, FIG. 9 shows a detail of the reel-receiving device in an axial longitudinal section, FIG. 10 shows, in a diagramatic representation, a side view of a device for connecting the ends of two sheets of material.

The drawings illustrate as a preferred example of use a packaging machine 20 which serves, for example, for producing (hard-box) cigarette packs. For this purpose, the packaging machine 20, the contours of which are shown in horizontal projection in FIG. 1, is equipped with a conventional cigarette magazine 21, a folding turret 22 and further conventional members. The cigarettes formed in groups are first wrapped in an inner wrapper consisting of tin foil or the like. Blanks for this are produced in the region of the packaging machine 20, specifically by being severed from a continuously supplied sheet 23 of packaging material. The sheet 23 in turn is drawn off from a reel 24 which, for this purpose, is located in the region of a consumption station 25. The production of the blanks and the packaging operation takes place in a known way.

A high-performance reel magazine 26 is assigned to the packaging machine 20. It is located in the region between the cigarette magazine 21 and the folding turret 22, in particular where the cigarettes are wrapped in the inner wrapper.

The reel magazine 26 consists of a reel turret 27, the consumption station 25 with two reel-receiving devices 28 and 29, and two reel conveyors 30 and 31 movable to and fro between the latter and the reel turret 27.

The reel turret 27 is provided with a plurality of reel holders 32, 33, 34. In the present exemplary embodiment, six reel holders 32, 33, 34 of this type are arranged on a common supporting frame 35. This is mounted on an axial journal 37 by means of pivot bearings 36. The reel holders 32, 33, 34 are arranged at equal angular distances from one another on the supporting frame 35 which is driven to rotate in a vertical plane about the horizontal axle journal 37. The arrangement is such that the two particular reel holders 33, 34 located at the top assume an extraction position. In this position, reels 24 are extracted from the reel holders 33 and 34 and transferred to the consumption station 25 as required. The reels 24 of these reel holders 33, 34 in the extraction position lie with their axes essentially in a common horizontal plane.

The reel holders 32, 33, 34 are designed so that they grasp and retain the reels 24 received in them along an outer periphery which is greater than 180°. It is thereby possible to carry the reels 24 even when the reel holders 32 point downwards. For this purpose, each reel holder 32, 33, 34 consists of an outer supporting shell 38 in the form of an arc of a circle. These supporting shells extend over an outer periphery of the reels 24 which is considerably greater than 180°. However, with part of their periphery, the reels 24 project from the supporting shells 38 of the outer periphery of the reel turret 27.

Supporting members for the reels 24 are arranged at a peripheral distance from one another within the supporting shells 38, specifically, in the present case, three groups of supporting rollers 39, 40, 41. These are arranged rotatably on journals 42 in inward-projecting bearing blocks 43 of the supporting shells 38. The reels 24 rest respectively on the supporting rollers 39, 40, 41 in the manner of a three-point mounting. The distance between the groups of supporting rollers 39, 40, 41 in a peripheral direction is such that the reels 24 are supported sufficiently even when the reel holders 32 point downwards.

As is evident, for example, from FIG. 5, each supporting shell 38 is equipped in the axial longitudinal direction, in the region of each group, with a plurality of supporting rollers 39, 40, 41 arranged closely next to one another. The distance between these supporting rollers 39, 40, 41 is selected so that each reel 24 is supported within a reel holder 32, 33, 34 by two supporting rollers 39, 40, 41 per group. The supporting rollers 39, 40, 41 also allow the reels 24 to be displaced in the axial direction of the reel holers 32, 33, 34. Cavities 44 and 45 are formed between each of the groups of supporting rollers 39, 40, 41.

As is evident especially from FIG. 1 and FIG. 5, the reel magazine 26 is arranged on the packaging machine 20 in such a way that the reel turret 27 is located on the rear side of the packaging machine 20. As a result, the individual reel holders 32, 33, 34 can be loaded with reels 24 from the open rear side. The axle journal 37 is connected to the machine frame of the packaging machine 20. A gear wheel 46 located on the supporting frame 35 is driven via a pinion 47 periodically, that is to say, each time, through an angle corresponding to two reel holders 32, 33, 34.

The reels 24 located in the (upper) reel holders 33, 34 are transferred to the consumption station 25 as required, in particular to the reel-receiving devices 28 and 29 assigned to each reel holder 33, 34.

These reel-receiving devices each consist essentially of a hub 48, 49 facing the reel holders 33, 34 with its free side. A reel 24 is received on each of these hubs, to allow the sheet 23 to be drawn off continuously. The two hubs 48 and 49 are arranged on a cross piece 50 which is connected to the machine frame via a supporting arm 51.

Either one of the reels 24 on the hubs 48 and 49 is located in the working position in which the sheet 23 is drawn off. As soon as the particular reel 24 is consumed, one end of the sheet 23 running off is connected to the start of the sheet 23 of the new reel 24. FIG. 10 shows diagramatically a sheet connector 52 which is to be actuated manually and which can be used in the present case. The sheet 23 running off passes over a lower deflecting roller 53 which at the same time forms a pivot bearing 54 for a pivotable pressure jaw 55 to be actuated by hand. In the present case, the free sheet end 56 of the new sheet 23 to be connected is fixed on the pressure jaw 55, specifically by means of suction air via suction bores 57. A second pressure jaw 58 is pivotable likewise about a pivot bearing 59 arranged axis-parallel.

In the present illustration, to connect the sheet end 56 to the end of the sheet 23 running off, the pressure jaw 58 is pivoted in an anti-clockwise direction into the position shown by dot-and-dash lines at the same time, the sheet 23 likewise retained via suction bores 66 being carried along with it and severed in the region of a fixed severing knife 61 by means of a counter-knife 62 located on the pressure jaw 58. The end of the running-off sheet 23 now formed is pressed against the sheet end 56, held ready, by the pressure jaw 58 moved further and is connected by means of adhesive or the like. In this way, the sheet 23 joined to a sheet end 56 becomes the running-off sheet. When the associated reel 24 has been consumed the operation takes place in the opposite direction (FIG. 10).

In the exemplary embodiment illustrated, all the reels 24 are extracted from the reel holders 33 and 34 in the region of the consumption station 25. For this purpose, the reel conveyors 30, 31 are assigned respectively to the reel holders 33, 34 in the upper position. These reel conveyors extract all the reels 24 from the reel holders 33, 34 and feed a particular reel 24 located at the front to the reel-receiving device 28 or 29.

The reel conveyors 30, 31 consist of a supporting trough 63 which matches the outer contour of the reels 24. On the edges of the supporting troughs 63 extending over a (lower) part periphery of the reels 24 are formed supporting ribs 64 and 65, on which the reels 24 rest positively during the time when they are received in the supporting troughs 63. The supporting troughs 63 are mounted displaceably so as to slide on (two) supporting rods 66, 67. The supporting rods extend from the reel turret 27 directly into the region of the reel-receiving devices 28 and 29, in particular extending beyond the hubs 48, 49.

The supporting troughs 63 and the supporting rods 66, 67 are mounted so that, when reels 24 are transferred from the reel holders 33, 34, the supporting troughs can penetrate into the latter so as to nest in them, specifically into the cavity 44, 45. The relative position is such that, at the same time, the supporting ribs 64, 65 lie in the plane of the peripheral surfaces of the reels 24, that is to say in the bearing plane pre-determined by the supporting rollers 39, 40, 41. When the group of reels 24 is grasped on the outside (at the top in FIG. 1), the entire content of the reel holders 33, 34 can be conveyed into the initial position as a result of the displacement of the supporting trough 63.

For this purpose, the supporting trough 63 is designed on its underside with a rack 68 extending in the longitudinal direction. There engages with the latter a pinion 69 which is attached in or on the machine frame and which is driven in a suitable way. The supporting troughs 63 are designed with an extension piece 70 which is retained by the supporting rods 66, 67 when the supporting troughs 63 are introduced completely into the reel holders 33, 34 for the transfer of reels 24 (the position according to FIG. 6).

The supporting troughs 63 have pawl-shaped engagement means 71, 72, 73. These are each assigned to a reel 24, in such a way that in the engagement position a reel 24 is grasped on the side face which is at the rear in the conveying direction. When the complete group of (three) reels 24 has been removed from a reel holder 33, 34, the engagement means 71 grasps the outer reel 24 on its end face.

Each supporting trough 63 is equipped with two groups of engagement means 71, 72, 73 of this type. These are mounted pivotably outside a space taken up by the reels 24 within the supporting troughs 63 and are designed as two-armed levers (FIG. 8). One lever arm 74 is designed with a supporting surface 75 resting against the reel 24, whilst the other lever arm 76 is supported elastically by a (compression) spring 77. The lever arms 74, 76 arranged at an angle to one another result in an angled position of the engagement means 71, 72, 73. The mounting and elastic support produce a barb effect. In a specific direction of movement of the supporting troughs 63 relative to the reels 24, the engagement means 71, 72, 73 are inoperative because they are pivoted (in an anti-clockwise direction in FIG. 8), whereas in the case of a relative movement in the opposite direction they perform a supporting or engaging function.

When a supporting trough 63 penetrates into a reel holder 33, 34, the engagement means 71, 72, 73 are first moved past the reels 24, until the outer or last engagement means 71 grasps the outer reel 24. At the same time the other engagement means 72, 73 are inoperative as a result of being pivoted.

As a result of the return movement (from right to left in FIG. 6), the group of reels 24 is now conveyed by the supporting trough 63 out of the respective reel holder 33, 34 into a position according to FIG. 5, on condition that the associated reel-receiving device 28, 29 is empty. In this position, the reel 24 located at the front in the direction of movement is pushed onto the associated hub 48, 49, specifically as a result of the conveying movement of the supporting trough 63. When this reel 24 is grasped and fixed on the hub 48, 49, the supporting trough 63 moves back into a position shown, for example, in FIG. 2 in relation to the (upper) reel conveyor 30. In this position, the following reels 24 in the supporting trough 63 and the latter itself are at a sufficient distance from the reel-receiving device 28 or 29, so that the sheet 23 can be drawn off undisturbed from the reel 24 now in the working position.

During the return movement of the supporting trough 63 from the feed position, as shown, for example, in FIG. 8, into the position of the reel conveyor 30 in FIG. 2, the (two) reels 24 remaining in the supporting trough 63 run against a stop 78 which can be introduced from the side into the path of movement of the supporting trough 63 or of the reels 24. The reels 24 in the supporting trough 63 are retained as a result, whilst the supporting trough 63 itself is moved further. The relative displacement of the reels 24 within the supporting trough 63 continues until the next following reel 24 assumes a front position facing the reel-receiving device 28, 29. At the same time, as a result of this, the next engagement means 72 comes to rest against the facing side face of the next, originally central reel 24. The supporting trough 63 can now serve as a feed conveyor to the next reel 24, when that previously pushed onto the hub 48 49 has been consumed. The same operation then takes place with regard to the third reel 24 within the supporting trough 63. FIG. 7 shows how this last reel 24 is pushed onto the hub 48, 49 by means of the supporting trough 63 under the effect of the engagement means 73. During the preceding return movement, further stops 79 are activated, and these likewise cause relative displacement of the reels 24 within the supporting trough 63.

The supporting troughs 63 are designed with a longitudinal groove 80 which allows them to be introduced into the reel holder 33, 34 as a result of the penetration of the supporting rollers 40 or of the associated bearing block 43 into this longitudinal groove 80.

The reel-receiving device 28, 29 and the hub 48, 49 are also designed in a special way. The reels 24 are conventionally provided with an inner sleeve-shaped core 81 consisting mainly of cardboard. This core 81 remains as a residue on the hub 48, 49 when the reel 24 has been emptied. The reels 24 are retained on the hub 48, 49 via the core 81, in the present exemplary embodiment by means of hook-shaped clamping jaws 82 movable essentially radially. Several of these, in the present exemplary embodiment two, are arranged opposite one another. The clamping jaws 82 are designed as pivotable levers with hook-shaped ends. The predominant part of the clamping jaws 82 is mounted within the hollow hub 48, 49, in particular in a pivot bearing 83. An actuating lever 84 projecting beyond this pivot bearing 83 and connected to the particular clamping jaw 82 is connected to a common connecting rod 85. This projects from the hub 48, 49 in the form of a handle on the side located opposite the reel 24. In the present exemplary embodiment, when the connecting rod 85 is pulled, the clamping jaws 82 are pivoted inwards in such a way that the core 81 can be drawn off freely from the hub 48, 49. The pivoting movement takes place against the load of a (compression) spring 86 which, in the present case, is arranged as a spreader spring between the two clamping jaws 82 located diametrically opposite one another. These are thus pressed into the clamping position (FIG. 9) by the spring 86. In the present exemplary embodiment, there is opposite the clamping jaws 82 or their hook-shaped retaining ends an abutment disk 87, against which the reel 24 is pressed by the clamping jaws 82 during the run-off of the sheet 23. The hook-shaped ends of the clamping jaws 82 can be designed with bevelled edges, in such a way that, in the working position (FIG. 9), they press into the material of the core 81 (cardboard) and thus also retain the latter positively and secure it against relative rotation.

Otherwise, the hub 48, 49 can be designed in a conventional way.

We claim:

1. A cigarette packaging machine for packaging groups of cigarettes in cuts of packaging material severed from a material strip wound on a reel, comprising:

(a) a generally cylindrically shaped reel magazine (26) with a plurality of reel holders (32, 33, 34), arranged about the circumference of the magazine which can be brought sequentially into a reel removal position, each reel holder for holding several reels placed next to each other;

(b) a consumption station (25) with at least two reel receiving devices (28, 29) for receiving reel from reel holders in their reel removal position, and (c) a reel conveyor (31) movable back and forth for supplying the reels coming from the reel holders to the reel-receiver devices.

2. The cigarette packaging machine according to claim 1 or 2, wherein the reel holders have an at least carrying frame turning around a horizontal turning axis.

3. The cigarette packaging machine according to claim 1 or 22, wherein the reel holders have an at least partially circular cross section which surrounds and holds a plurality of reels about a circumferential range of more than 180°.

4. The cigarette packaging machine as claimed in claim 1, wherein the reels (24) are supported in the reel holders (32, 33, 34) on several supporting rollers (39, 40, 41), offset more than 90° relative to one another.

5. The cigarette packaging machine as claimed in claim 4, wherein each reel holder (32, 33, 34) is provided with several supporting rollers (39, 40, 41) arranged in at least two rows, extending in the longitudinal direction of the reel holders (32,33,34).

6. The cigarette packaging machine as claimed in claim 4, wherein each reel holder (32, 33, 34) comprises a supporting shell (38) with a circular cross-section, in which the supporing rollers (39, 40, 41) are attached, the supporting shells (38) of the reel holders (32, 33, 34) being connected to one another to form the supporting frame (35) mounted on an axle journal (37).

7. The cigarette machine as claimed in claim 1, wherein six reel holders (32, 33, 34) are arranged along an arc of a circle at equal angular distances from one another, and at any particular time two reel holders (33, 34) are simultaneously provided in the reel removal position for the extraction of reels (24).

8. The cigarette packaging machine as claimed in claim 7 further including means for alternately pushing the reels (24) out of the reel holders (33, 34) located in the reel removal position onto one of two fixed hubs (48, 49) of a respective reel receiving device (28, 29).

9. The cigarette packaging machine as claimed in claim 1, wherein the reel-receiving devices include hubs (48, 49) and on the hubs (48, 49) of the reel-receiving devices (28, 29), clamping jaws (82), each movable radially inwards against elastic pressure, are assigned to the core (81) of the reels (24) on the hubs (48, 49), and the clamping jaws (82) are movable radially inwards against the pressure of a spring (86) to remove the core (81), especially by means of a connecting rod (85).

10. The cigarette packaging machine as claimed in claim 1, further including means for causing all the reels (24) of a particular reel holder (33, 34) to be received at the same time by the reel conveyor (30, 31) and fed in succession by the latter to the reel-receiving devices (28, 29).

11. The cigarette packaging machine as claimed in claim 4, wherein the reel conveyor (30, 31) has a supporting trough (63) with longitudinally directed supporting ribs 64, 65 for the periphery of the reels (24), located approximately in the supporting plane of the supporting rollers (39, 40, 41) of the reel holders (32, 33, 34).

12. The cigarette packaging machine as claimed in claim 11, wherein the reel conveyor (30, 31) with its supporting trough (63) and supporting ribs (64, 65) can be introduced into a cavity (44, 45) of an associated reel holder (32, 33, 34), in such a way that the supporting ribs (64, 65) extend approximately in the plane of the periphery of the reels (24) in the region of the reel holders (32, 33, 34), and wherein, during a return movement of the real conveyor (30, 31), the reels (24) resting on the supporting ribs (64, 65) are conveyed out of the reel holder (32, 33, 34) while maintaining an unchanged relative position as they are supported on the supporting trough (63) of the reel conveyor (30, 31).

13. The cigarette packaging machine as claimed in claim 1, wherein the reel conveyor includes a supporting trough (63) which has engagement means (71, 72, 73) grasping the reels (24) on their rear side face.

14. The cigarette packaging machine as claimed in claim 13, wherein the engagement means (71, 72, 73) are pivotable pawls which are movable from a retracted or swung-away position outside the region of the reels (24) into an engagement position.

15. The cigarette packaging machine as claimed in claim 14, wherein the engagement means (71, 72, 73) are two-armed levers, one lever arm (74) of which is designed to grasp the rear side face of a reel (24) by means of a supporting surface (75) and the other lever arm (76) of which is supported on a spring (77) and is loaded into the engagement position.

16. The cigarette packaging machine as claimed in claim 13, wherein each reel conveyor includes a supporting trough (63) equipped with a number of engagement means (71, 72, 73) corresponding to the number of reels (24) to be received, for grasping the reels (24) in succession on their rear side faces so as to push them onto the reel-receiving device (28 or 29).

17. The cigarette packaging machine as claimed in claim 1, wherein the reels (24) are relatively displaceable on the reel conveyor (30, 31) which includes a supporting trough (63) for receiving reels, said displacement being in the direction of the reel-receiving device (28, 29) as a result of a return movement of the reel conveyor (30, 31), and further including movable stops (78, 79) for retaining the reels during return movement of the reel conveyor whereby the reel (24) located at the front in the direction of movement can be pushed onto the reel-receiving device by the reel conveyor (30, 31).

18. The cigarette packaging machine as claimed in claim 1, wherein the reel conveyor (30, 31) includes a supporting trough (63) which is movable to and fro by means of a reversible drive motor via a pinion (69) and a rack (68) arranged on the underside of the supporting trough (63), and the supporting trough (63) is supported displaceably on fixed supporting rods (66, 67).

19. The cigarette packaging machine as claimed in claim 1, wherein a sheet connector (52) for connecting the ends of sheets (23) from one reel-receiving device (28, 29) and the other is assigned to the two reel-receiving devices (28, 29) connected to one another by means of a cross piece (50).

* * * * *